US005530980A

United States Patent [19]

Sommerhalter, Jr.

[11] Patent Number: 5,530,980

[45] Date of Patent: Jul. 2, 1996

[54] LEG STABILIZATION SLEEPING DEVICE

[76] Inventor: Louis Sommerhalter, Jr., 77 E. Missouri Ave. #67, Phoenix, Ariz. 85012

[21] Appl. No.: 340,534

[22] Filed: Nov. 16, 1994

[51] Int. Cl.[6] ..... A47C 20/02

[52] U.S. Cl. ..... 5/648; 5/624

[58] Field of Search ..... 5/624, 646, 648, 5/649, 650, 651; 403/389, 391, 396

[56] References Cited

U.S. PATENT DOCUMENTS

| | | | |
|---|---|---|---|
| 988,923 | 4/1911 | Baverfeind | 5/646 |
| 4,373,709 | 2/1983 | Whitt | 5/624 |
| 4,390,015 | 6/1983 | Clements | 5/650 |
| 5,369,827 | 12/1994 | Parke et al. | 5/649 |
| 5,403,350 | 4/1995 | McAtee | 5/648 |
| 5,410,769 | 5/1995 | Waterman | 5/646 |

*Primary Examiner*—Steven N. Meyers
*Assistant Examiner*—Robert G. Santos

[57] ABSTRACT

A sleeping device for stabilizing the legs of an individual during sleep to maintain the individual's back in a desired position. The inventive device includes a first engaging member pivotally coupled to a second engaging member. The engaging members cooperate to receive adjacent portions of the individual's legs to maintain the legs in a spaced and parallel orientation.

1 Claim, 3 Drawing Sheets

LEG STABILIZATION SLEEPING DEVICE

BACKGROUND OF THE INVENTION

1. Field of the Invention

The present invention relates to supporting devices and more particularly pertains to a leg stabilization sleeping device for stabilizing the legs of an individual during sleep.

2. Description of the Prior Art

The use of supporting devices is known in the prior art. More specifically, supporting devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art supporting devices include U.S. Pat. Nos. 4,901,385; 4,432,108; 5,048,542; 4,736,477; 4,177,806; and 4,910,818.

While these devices fulfill their respective, particular objectives and requirements, the aforementioned patents do not disclose a leg stabilization sleeping device for stabilizing the legs of an individual during sleep which includes a first engaging member pivotally coupled to a second engaging member, wherein the engaging members cooperate to receive adjacent portions of the individual's legs to maintain the legs in a spaced and parallel orientation.

In these respects, the leg stabilization sleeping device according to the present invention substantially departs from the conventional concepts and designs of the prior art, and in so doing provides an apparatus primarily developed for the purpose of stabilizing the legs of individual during sleep to maintain the individual's back in a desired position.

SUMMARY OF THE INVENTION

In view of the foregoing disadvantages inherent in the known types of supporting devices now present in the prior art, the present invention provides a new leg stabilization sleeping device construction wherein the same can be utilized for stabilizing the legs of an individual during sleep. As such, the general purpose of the present invention, which will be described subsequently in greater detail, is to provide a new leg stabilization sleeping device apparatus and method which has many of the advantages of the supporting devices mentioned heretofore and many novel features that result in a leg stabilization sleeping device which is not anticipated, rendered obvious, suggested, or even implied by any of the prior art supporting devices, either alone or in any combination thereof.

To attain this, the present invention generally comprises a sleeping device for stabilizing the legs of an individual during sleep to maintain the individual's back in a desire position. The inventive device includes a first engaging member pivotally coupled to a second engaging member. The engaging members cooperate to receive a adjacent portions of the individual' legs to maintain the legs in a spaced and parallel orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new leg stabilization sleeping device apparatus and method which has many of the advantages of the supporting devices mentioned heretofore and many novel features that result in a leg stabilization sleeping device which is not anticipated, rendered obvious, suggested, or even implied by any of the prior art supporting devices, either alone or in any combination thereof.

It is another object of the present invention to provide a new leg stabilization sleeping device which may be easily and efficiently manufactured and marketed.

It is a further object of the present invention to provide a new leg stabilization sleeping device which is of a durable and reliable construction.

An even further object of the present invention is to provide a new leg stabilization sleeping device which is susceptible of a low cost of manufacture with regard to both materials and labor, and which accordingly is then susceptible of low prices of sale to the consuming public, thereby making such leg stabilization sleeping devices economically available to the buying public.

Still yet another object of the present invention is to provide a new leg stabilization sleeping device which provides in the apparatuses and methods of the prior art some of the advantages thereof, while simultaneously overcoming some of the disadvantages normally associated therewith.

Still another object of the present invention is to provide a new leg stabilization sleeping device for stabilizing the legs of an individual during sleep.

Yet another object of the present invention is to provide a new leg stabilization sleeping device which includes a first engaging member pivotally coupled to a second engaging member, wherein the engaging members cooperate to receive adjacent portions of the individual's legs to maintain the legs in a spaced and parallel orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
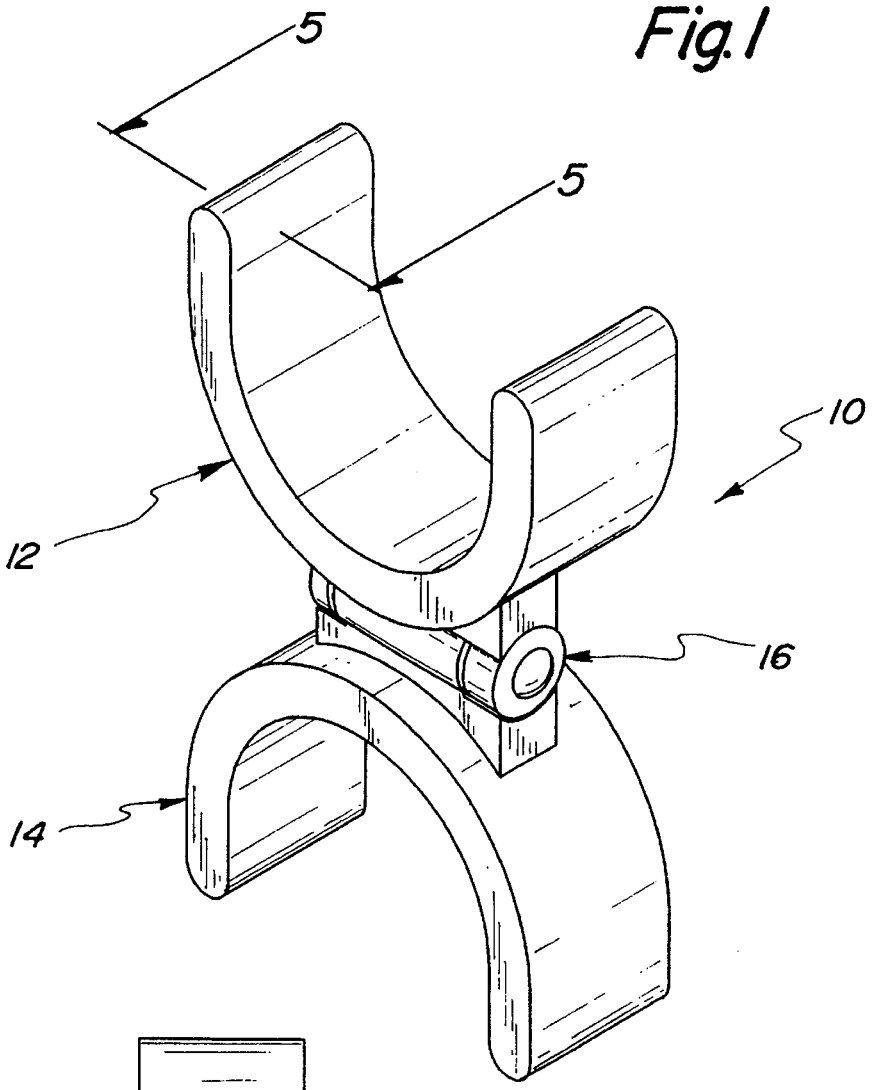
FIG. 1 is an isometric illustration of a leg stabilization sleeping device according to the present invention.
Figure 2:
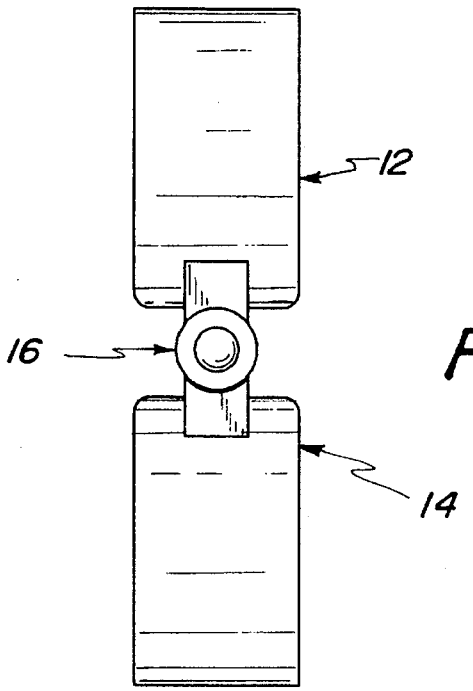
FIG. 2 is a side elevation view thereof.

With reference now to the drawings, and in particular to FIGS. 1–6 thereof, a new leg stabilization sleeping device embodying the principles and concepts of the present invention and generally designated by the reference numeral 10 will be described.

More specifically, it will be noted that the leg stabilization sleeping device 10 comprises a first engaging means 12 for receiving a portion of a first leg of an individual, a second engaging means 14 for receiving a portion of a second leg of the individual, and a coupling means 16 for pivotally coupling the first engaging means relative to the second engaging means. By this structure, a first one of the individual's legs can be received within the first engaging means 12, with a second one of the individual's legs being received within the second engaging means 14 so as to position and maintain the legs in a spaced and parallel orientation during sleep. Such orientation of the legs precludes a rotation of the individual's hips, thereby maintaining the person in a Williams position or fetal position during sleep.

Figure 3:
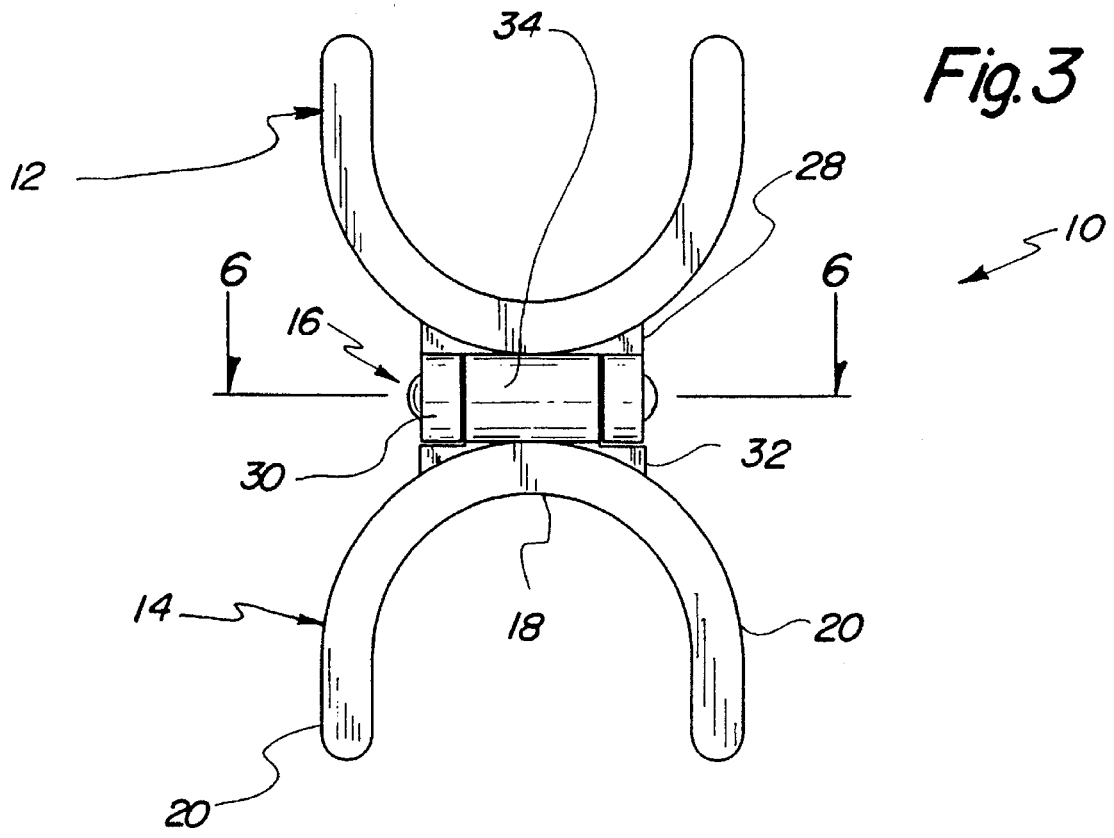
FIG. 3 is a front elevation view of the invention.
Figure 4:
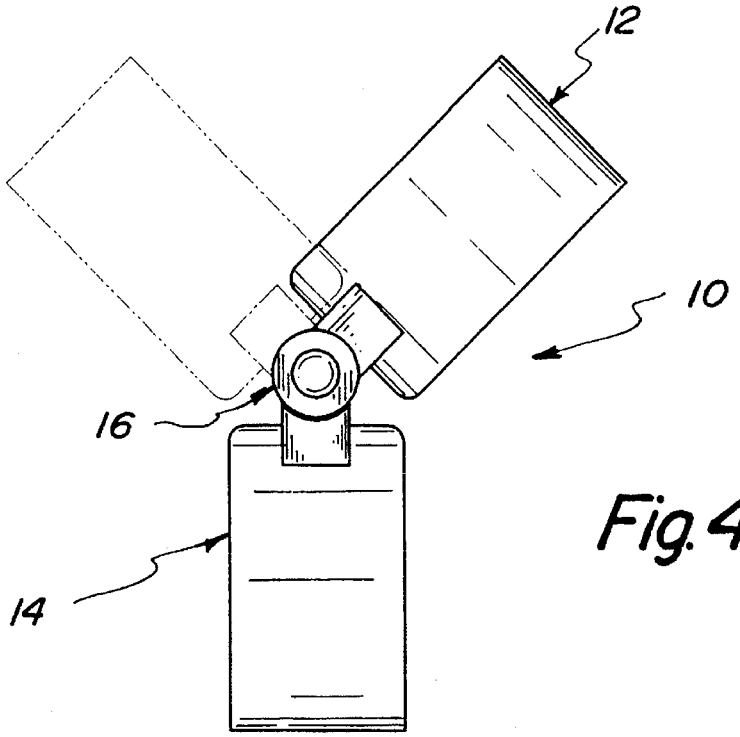
FIG. 4 is a further side elevation view of the invention illustrating an articulation of a first engaging means relative to a second engaging means.
Figure 5:
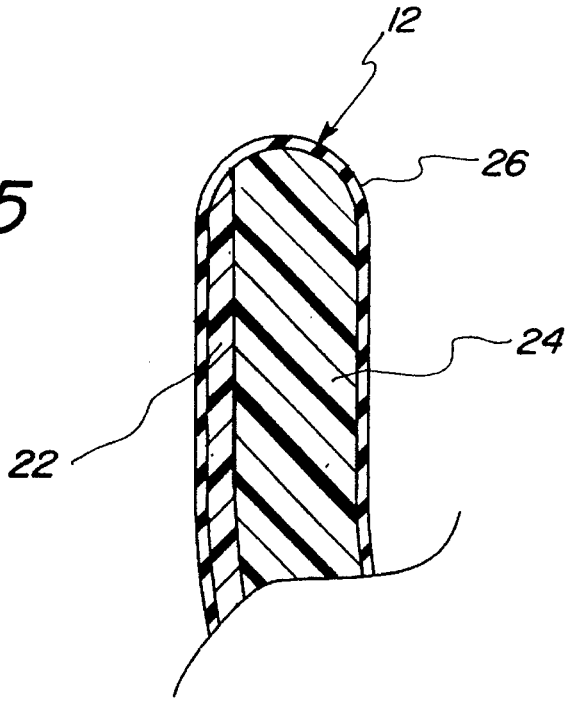
FIG. 5 is a cross sectional view taken along line 5—5 of FIG. 1.

As best illustrated in FIGS. 3 and 4 of the drawings, it can be shown that each of the engaging means 12, 14 is substantially similar in shape and configuration and comprises a substantially semi-cylindrical center section 18 having opposed lateral ends with a pair of lateral sections 20 projecting from the lateral ends and into a substantially spaced and parallel orientation relative to one another to define the substantially U-shape of each of the engaging means 12, 14. As illustrated in FIG. 5, each of the engaging means 12, 14 is comprised of a substantially U-shaped interior frame 22 having a resilient foam material 24 coupled along an interior surface thereof and extending coextensively therewith. An exterior skin 26 encapsulates both the interior frame 22 and the resilient foam material 24 to completely enclose together the safe. Preferably, the interior frame 22 is comprised of a substantially resilient plastic material which permits a resilient deformation of the engaging means 12, 14 so as to resiliently and frictionally engage the individual's legs when positioned between the lateral sections 20 and into contact with the semi-cylindrical center section 18.

Figure 6:
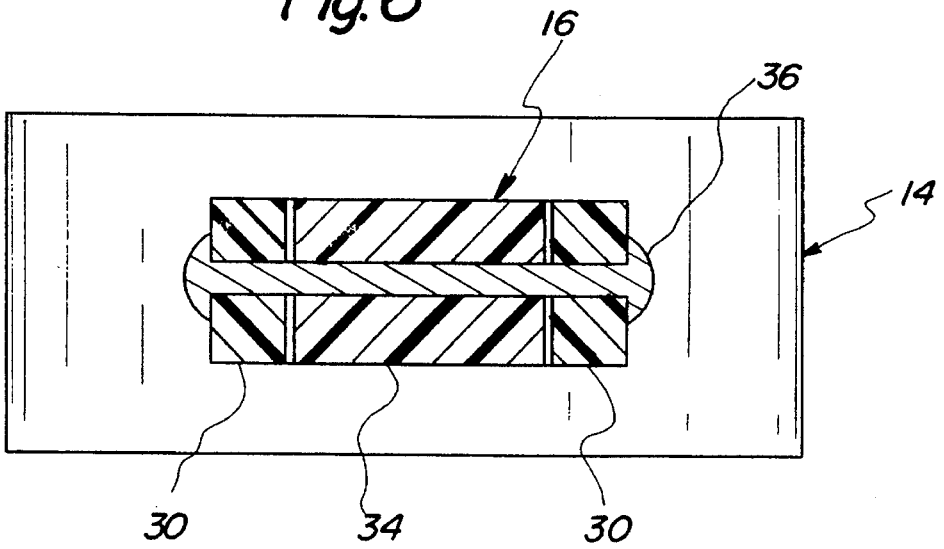
FIG. 6 is a further cross sectional view taken along line 6—6 of FIG. 3.

Referring now to FIG. 6 with concurrent reference to FIG. 3, it can be shown that the coupling means 16 according to the present invention 10 comprises a first mounting block 28 coupled to an exterior surface of the semi-cylindrical center section 18 of the first engaging means 12. A pair of pivot plates 30 are coupled to the first mounting block 28 and positioned in a substantially spaced and parallel orientation relative to one another. Similarly, a second mounting block 32 is coupled to an exterior surface of the semi-cylindrical center section 18 of the second engaging means 14 and mounts a cylindrical pivot tube 34 between the pivot plates 30. As shown in FIG. 6, a pivot pin 36 extends through both of the pivot plates 30 and the pivot tube 34 to pivotally couple the first mounting block 28 relative the second mounting block 32. By this structure, the coupling means 16 permits articulation of the first engaging means 12 relative to the second engaging means 14 about an axis extending through the pivot pin 36.

In use, the leg stabilization sleeping device 10 can be easily positioned between adjacent portions of an individual's legs. If desired, a first leg stabilization sleeping device 10 can be positioned between the thigh portions of the individual's legs, with a second leg stabilization sleeping device 10 being positioned between the calf portions of the individual's legs. The leg stabilization sleeping device 10, utilized either alone or in a pair, operates to maintain the legs of the individual in a spaced and parallel orientation. Such orientation of the individual's legs will preclude an undesired rotation of the individual's hips during sleep to preclude a twisting or torquing of the individual's back during sleep which could cause pain.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A leg stabilization sleeping device comprising:

a first engaging means adapted to receive a portion of a first leg of an individual;

a second engaging means adapted to receive a portion of a second leg of an individual;

each of the engaging means being substantially similar in shape and configuration and comprising a U-shaped interior frame including a substantially semi-cylindrical center section having opposed lateral ends with a pair of lateral sections projecting from the lateral ends and into a substantially spaced and parallel orientation relative to one another to define a substantially U-shape of the engaging means, each of the engaging means further comprising a resilient foam material coupled along an interior surface of the U-shaped interior frame and extending coextensively therewith; and an exterior skin encapsulating both the interior frame and the resilient foam material to enclose together the interior frame and the resilient foam material, the U-shaped interior frame comprising a substantially resilient plastic material, the plastic material being resiliently deformable to permit resilient and frictional engagement of the leg of an individual positioned between the lateral sections and into contact with the semi-cylindrical center section; and, a coupling means adapted to pivotally couple the first engaging means relative to the second engaging means, the coupling means comprising a first mounting block coupled to an exterior surface of the semi-cylindrical center section of the first engaging means; a pair of pivot plates coupled to the first mounting block and positioned in a substantially spaced and parallel orientation relative to one another; a second mounting block coupled to an exterior surface of the semi-cylindrical center section of the second engaging means; a cylindrical pivot tube mounted to the second mounting block and positioned between the pivot plates; and a pivot pin extending through both of the pivot plates and the pivot tube to pivotally couple the first mounting block relative the second mounting block, whereby the first one of in individual's legs can be received within the first engaging means, the second one of an individual's legs can be received within the second engaging means so as to position and maintain the legs in a spaced and parallel orientation during sleep.

* * * * *